US010960365B2

(12) United States Patent
Yamamoto et al.

(10) Patent No.: US 10,960,365 B2
(45) Date of Patent: Mar. 30, 2021

(54) APPARATUS AND METHOD FOR PRODUCING FINE AIR BUBBLE MIXED LIQUID

(71) Applicant: NISSIN GIKEN CO., LTD., Higashiosaka (JP)

(72) Inventors: Shinichi Yamamoto, Higashiosaka (JP); Kenichi Yamamoto, Higashiosaka (JP)

(73) Assignee: NISSIN GIKEN CO., LTD., Higashiosaka (JP)

( * ) Notice: Subject to any disclaimer, the term of this patent is extended or adjusted under 35 U.S.C. 154(b) by 379 days.

(21) Appl. No.: 16/302,513

(22) PCT Filed: May 23, 2017

(86) PCT No.: PCT/JP2017/019156
§ 371 (c)(1),
(2) Date: Nov. 16, 2018

(87) PCT Pub. No.: WO2017/204205
PCT Pub. Date: Nov. 30, 2017

(65) Prior Publication Data

US 2019/0275477 A1 Sep. 12, 2019

(30) Foreign Application Priority Data

May 24, 2016 (JP) ..... JP2016-103475

(51) Int. Cl.
*B01F 3/04* (2006.01)
*B01F 5/10* (2006.01)
(Continued)

(52) U.S. Cl.
CPC ..... *B01F 3/04609* (2013.01); *B01F 3/04* (2013.01); *B01F 3/0451* (2013.01);
(Continued)

(58) Field of Classification Search
CPC ..... B01F 3/04609; B01F 3/04; B01F 5/10; B01F 5/02; B01F 3/0451; B01F 5/104;
(Continued)

(56) References Cited

U.S. PATENT DOCUMENTS 1,031,666 A * 7/1912 Richmond ..... B01F 7/1625 366/265
3,024,011 A * 3/1962 Wurdack ..... B01F 7/285 416/181

(Continued)

FOREIGN PATENT DOCUMENTS

JP 2001-104764 A 4/2001

*Primary Examiner* — Tony G Soohoo
(74) *Attorney, Agent, or Firm* — Muncy, Geissler, Olds & Lowe, P.C.

(57) ABSTRACT

A fine-bubble mixed liquid producing apparatus 1 includes a reservoir 4 and a bubble feeding means 6 for feeding bubbles to a liquid L stored in the reservoir 4, wherein the bubble feeding means 6 includes a rotary cylinder 20 having an emitting part 22 on the outer circumferential surface, the emitting part 22 for being rotationally driven by a drive means 10, a circulating means 40 for drawing out the liquid L stored in the reservoir 4 and feeding the liquid L from the emitting part 22 to the reservoir 4, and a gas-liquid mixing part 50 for mixing bubbles with the liquid L circulated by the circulating means 40. This apparatus enables a fine-bubble mixed liquid to be efficiently produced.

5 Claims, 4 Drawing Sheets

(51) Int. Cl.
*B01F 7/18* (2006.01)
*B01F 7/28* (2006.01)
*B01F 5/02* (2006.01)
*B01F 3/08* (2006.01)

(52) U.S. Cl.
CPC ..... *B01F 3/0876* (2013.01); *B01F 5/02* (2013.01); *B01F 5/10* (2013.01); *B01F 5/104* (2013.01); *B01F 5/106* (2013.01); *B01F 7/18* (2013.01); *B01F 7/285* (2013.01)

(58) Field of Classification Search
CPC .. B01F 5/106; B01F 7/18; B01F 7/285; B01F 5/0212; B01F 5/0231; B01F 3/0786
See application file for complete search history.

(56) References Cited

U.S. PATENT DOCUMENTS 3,415,650 A * 12/1968 Frame ..... G03C 1/015 430/642
3,785,777 A * 1/1974 Porter ..... B01F 7/164 422/225
4,515,482 A * 5/1985 Schadewald ..... B01F 5/12 366/136
4,683,062 A * 7/1987 Krovak ..... B01J 8/10 210/150
4,743,428 A * 5/1988 McRae ..... B01F 7/285 266/204
4,889,701 A * 12/1989 Jones ..... B01D 53/52 423/220
4,948,262 A * 8/1990 Tome, Jr. ..... B01F 7/00558 366/129
5,403,088 A * 4/1995 Killmer ..... B01F 3/04453 366/102
5,730,784 A * 3/1998 Smith ..... B03D 1/1493 95/181
5,951,921 A * 9/1999 Koganezawa ..... C02F 1/78 261/151
6,126,150 A * 10/2000 Van Dyk ..... B01F 3/04539 261/87
6,357,725 B2 * 3/2002 Nomura ..... B01F 3/04262 261/5
8,579,495 B2 * 11/2013 Blechschmitt ..... B01F 13/0283 366/101
9,815,033 B2 * 11/2017 Latva-Kokko ..... B01F 3/04517
2004/0022122 A1 * 2/2004 Kozyuk ..... B01F 3/1221 366/262
2006/0114744 A1 * 6/2006 White ..... B01F 15/0085 366/101
2012/0295248 A1 * 11/2012 Cheng ..... C12M 27/02 435/3
2019/0275477 A1 * 9/2019 Yamamoto ..... B01F 3/0876

* cited by examiner

APPARATUS AND METHOD FOR PRODUCING FINE AIR BUBBLE MIXED LIQUID

TECHNICAL FIELD

The present invention relates to an apparatus and a method for producing a fine-bubble mixed liquid.

BACKGROUND ART

To date, apparatuses are known that reduce the size of bubbles and mix such bubbles with a liquid in order to promote, for example, dissolution of a gas. A nozzle is a known means for producing fine bubbles, but since there is a limit to reducing the bubble size by way of reducing the nozzle diameter, for example, in Patent Literature 1, the size of bubbles to be fed to a liquid is reduced by compressing the bubbles by rotating rotary blades.

CITATION LIST

Patent Literature

Patent Literature 1: JP 2001-104764A

SUMMARY OF INVENTION

Technical Problem

However, the gas-liquid mixer disclosed in Patent Literature 1 requires rotary blades to be rapidly rotated in order to compress and mix gas and liquid, and thus there is a possibility that the rotational resistance is increased and that the load on the power source becomes excessive.

Accordingly, an object of the present invention is to provide an apparatus and a method for producing a fine-bubble mixed liquid, which are capable of efficiently producing a liquid mixed with fine bubbles.

Solution to Problem

The object of the present invention is achieved by a fine-bubble mixed liquid producing apparatus comprising a reservoir and a bubble feeding means for feeding bubbles to a liquid stored in the reservoir, wherein the bubble feeding means comprises:

- a rotary cylinder having an emitting part on an outer circumferential surface, wherein the rotary cylinder is for being rotationally driven by a drive means,
- a circulating means for drawing out the liquid stored in the reservoir and feeding the liquid from the emitting part to the reservoir, and
- a gas-liquid mixing part for mixing bubbles with the liquid circulated by the circulating means, and by immersing the emitting part in the liquid stored in the reservoir and rotating the rotary cylinder, a bubble-mixed liquid is emitted from the emitting part, and a fine-bubble mixed liquid is thus produced.

It is preferable that the rotary cylinder comprises rotary blades inside. It is more preferable that the rotary blades are disposed in a lower part of the rotary cylinder.

It is preferable that the fine-bubble mixed liquid producing apparatus further comprises an outer cylinder disposed coaxially with the rotary cylinder such that there is a space between the outer cylinder and the outer circumferential surface of the rotary cylinder.

Moreover, the object of the present invention is achieved by a method for producing a fine-bubble mixed liquid by mixing bubbles with a liquid stored in a reservoir, wherein a rotary cylinder having an emitting part on an outer circumferential surface is suspended; the rotary cylinder is rotated, with the emitting part being immersed in the liquid in the reservoir; the liquid in the reservoir is drawn out, mixed with bubbles, and then emitted from the emitting part; and the fine-bubble mixed liquid is thus produced.

Advantageous Effects of Invention

The present invention can provide an apparatus and a method for producing a fine-bubble mixed liquid, which are capable of efficiently producing a liquid mixed with fine bubbles.

DESCRIPTION OF EMBODIMENTS

Figure 1:
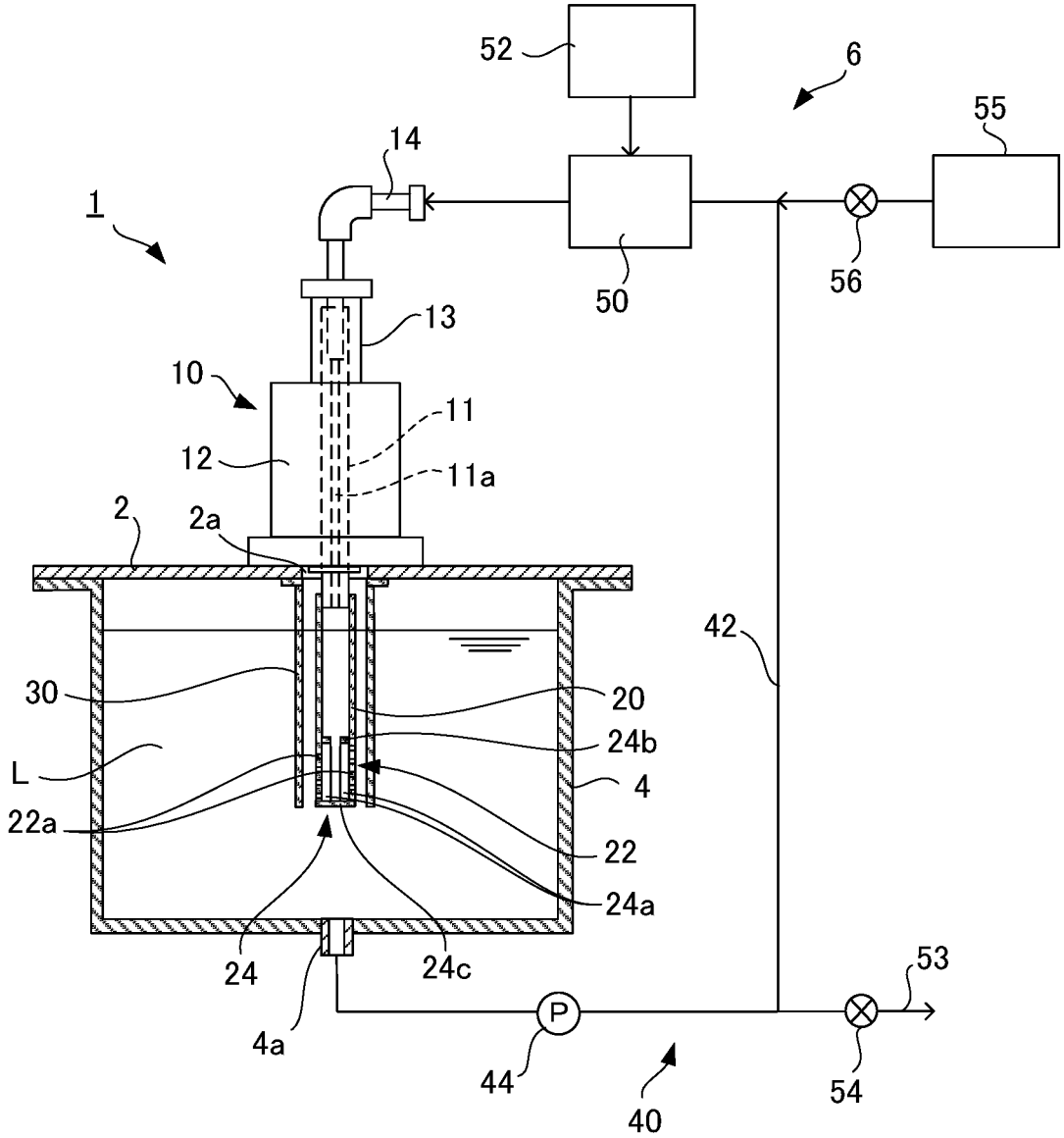
FIG. 1 is a vertical cross-sectional view of a fine-bubble mixed liquid producing apparatus according to one embodiment of the present invention.

Below, an embodiment of the present invention will now be described with reference to the attached drawings. FIG. 1 is a vertical cross-sectional view of a fine-bubble mixed liquid producing apparatus according to one embodiment of the present invention. As shown in FIG. 1, a fine-bubble mixed liquid producing apparatus 1 includes a reservoir 4 for storing a liquid L and a bubble feeder 6 for feeding bubbles to the liquid L in the reservoir 4.

The bubble feeder 6 includes a drive motor 10 fixed to the upper surface of a support plate 2 placed over the upper opening of the reservoir 4, a circular rotary cylinder 20 for being rotationally driven by the drive motor 10, an outer cylinder 30 suspended from the support plate 2 so as to accommodate the rotary cylinder 20, a circulator 40 for circulating the liquid stored in the reservoir 4, and a gas-liquid mixing part 50 for mixing bubbles with the liquid L circulated by the circulator 40. While the support plate 2 is disposed so as to hermetically close the reservoir 4 in the present embodiment, the support plate 2 may be configured to allow the inside and the outside of the reservoir 4 to be in communication. A weak electric current may be applied to the liquid L stored in the reservoir 4 by an ore, battery, or the like provided inside or outside the reservoir 4.

The drive motor 10 is configured such that the upper and lower ends of an output shaft 11 project from a casing 12. The output shaft 11 has an introduction path 11*a* that axially penetrates the central part. The upper end of the output shaft 11 is connected to an introduction part 14 via a rotary joint 13 in an airtight and relatively rotatable manner.

The lower end of the output shaft 11 extends through a through-hole 2*a* formed in the support plate 2, is securely connected to the upper end of the rotary cylinder 20, supports the rotary cylinder 20 so as to suspend the rotary cylinder 20, and rotationally drives the rotary cylinder 20. The rotary cylinder 20 is made of, for example, a metallic material such as stainless steel, and has an emitting part 22 composed of a plurality of emitting holes 22*a* in the outer circumferential surface of the lower part. The emitting holes 22*a* are formed at circumferentially equal intervals so as to uniformly discharge therearound a gas-liquid mixture introduced into the rotary cylinder 20 from the introduction path 11*a* of the output shaft 11 and, moreover, are also formed at axially equal intervals such that the emitting part 22 has a predetermined height (e.g., about 150 mm). The diameter of the emitting holes 22*a* is not particularly limited and is, for example, 0.1 to 1.5 mm. The rotary cylinder 20 preferably has a smooth outer circumferential surface without having stirring blades or the like.

Figure 2:
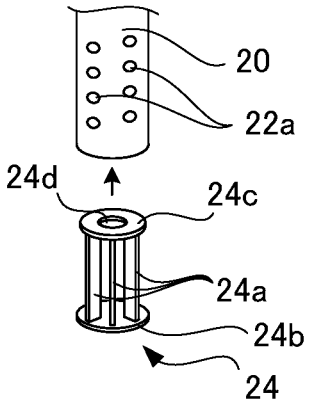
FIG. 2 is an exploded perspective view of a relevant part of the fine-bubble mixed liquid producing apparatus shown in FIG. 1.

A stirring member 24 is provided inside the lower part of the rotary cylinder 20. As shown in the exploded perspective view of FIG. 2, the stirring member 24 has a plurality of flat rotary blades 24*a* on a lower disc 24*b* having substantially the same diameter as the outer diameter of the rotary cylinder 20. In the case of providing a large number of the rotary blades 24*a*, it is preferable that the rotary blades 24*a* are radially disposed at equal intervals. An upper disc 24*c* having substantially the same diameter as the inner diameter of the rotary cylinder 20 is attached to the upper part of the rotary blade 24*a*. As indicated by the arrow in FIG. 2, the stirring member 24 is inserted from below the rotary cylinder 20 such that each rotary blade 24*a* is positioned between the circumferentially adjacent emitting holes 22*a*, and is fixed to the rotary cylinder 20 such that the lower disc 24*b* closes the lower opening of the rotary cylinder 20. The upper disc 24*c* has a communication hole 24*d* in the center, and a gas-liquid mixture introduced into the rotary cylinder 20 travels through the communication hole 24*d*, is stirred by the rotary blades 24*a*, and is emitted from the emitting holes 22*a*. The shape and the arrangement of the rotary blades 24*a* are not particularly limited as long as the rotary blades 24*a* are capable of producing a swirling flow inside the rotary cylinder 20. For example, curved, spiral, or airfoil-shaped rotary blades may be used in place of the flat rotary blades 24*a*.

The outer cylinder 30 is in the form of a straight cylinder made of a resin such as acryl or a metal such as stainless steel, and is disposed coaxially with the rotary cylinder 20 such that there is a space between the outer cylinder 30 and the outer circumferential surface of the rotary cylinder 20. The upper end of the outer cylinder 30 is fixed to the support plate 2. The lower end of the outer cylinder 30 substantially matches the lower end of the inner cylinder 20, and the emitting part 22 of the rotary cylinder 20 is covered by the outer cylinder 30. A helical guide plate (not shown) may be provided on the inner circumferential surface of the outer cylinder 30 so as to facilitate a swirling flow of the liquid L inside the outer cylinder 30.

The circulator 40 includes a pipe 42 connecting a discharge port 4*a* formed in the bottom of the reservoir 4 and the introduction part 14, and a circulation pump 44 that is disposed in the middle of the pipe 42 and draws out the liquid L in the reservoir 4 to the outside of the reservoir 4. The gas-liquid mixing part 50 is disposed in the middle of the pipe 42 more toward the downstream side than the circulation pump 44 is, and mixes the liquid L traveling inside with a pressurized gas fed from a gas feeder 52 such as a compressor or a gas cylinder.

The configuration of the gas-liquid mixing part 50 is not particularly limited, and may be of, for example, a pore blowing type in which bubbles are mixed with a liquid via pores of a porous film, a swirling flow type in which gas and liquid are rapidly swirled and mixed, or a Venturi type in which gas is introduced by utilizing the negative pressure generated by the traveling of the liquid L. Also, the gas-liquid mixing part 50 can be also configured to suck outside air and mix it with the liquid L without having the gas feeder 52. The gas-liquid mixture discharged from the gas-liquid mixing part 50 is fed to the reservoir 4 from the emitting part 22 of the rotary cylinder 20. Moreover, the gas-liquid mixing part 50 may be configured to include a liquid electrolyzer that produces bubbles by electrolyzing a liquid, and in this configuration, the produced bubbles may be fed to the pipe 42 as a mixture with a non-electrolyzed liquid. In the case of producing bubbles by a liquid electrolyzer, the liquid electrolyzer may be used in combination with the gas feeder 52, but the configuration that does not involve the gas feeder 52 can save energy.

A branch pipe 53 is connected to the pipe 42 constituting the circulation path, and by regulating the opening of an on-off valve 54 provided in the middle of the branch pipe 53, some of the gas-liquid mixture flowing through the pipe 42 can be continuously drawn out from the branch pipe 53. Also, the pipe 42 is configured to be capable of receiving the liquid L from a liquid feeder 55, and by regulating the opening of an on-off valve 56, the pipe 42 can be continuously replenished with the liquid L corresponding to the amount of liquid discharged from the branch pipe 53. The pipe 42 may be configured to include a magnetic treatment part for imparting a magnetic field to the inside of the pipe 42 using a permanent magnet or the like, and it is thus possible to enhance the ability to retain fine bubbles by magnetic treatment of the liquid.

Figure 3:
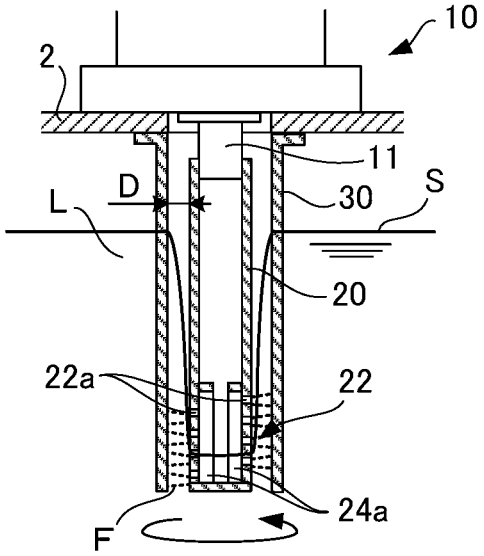
FIG. 3 is an enlarged view of a relevant part, showing a state during operation of the fine-bubble mixed liquid producing apparatus shown in FIG. 1.

Next, the operation of the fine-bubble mixed liquid producing apparatus 1 having the above configuration will now be described. As shown in FIG. 1, the liquid L such as water is stored in the reservoir 4, and substantially the entirety of the rotary cylinder 20 is immersed in the liquid. Then, activating the drive motor 10 and the circulation pump 44 causes the rotary cylinder 20 to be axially rotated together with the rotary blades 24*a* as indicated by the arrow in FIG. 3, and the gas-liquid mixture introduced into the rotary cylinder 20 from the circulator 40 becomes a swirling flow due to the rotary blades 24*a* and is discharged from the emitting part 22.

When the rotary cylinder 20 is rapidly rotated, a liquid surface S of the liquid L is depressed in a bowl-like shape, with the rotary cylinder 20 being in the center, and the liquid surface S around the rotary cylinder 20 is lowered to the vicinity of the emitting part 22 and moves up and down there. Accordingly, a jet flow F of the gas-liquid mixture discharged from each emitting hole 22*a* is stirred while colliding with the liquid surface S and incorporated into the liquid, and therefore the bubbles become finer and spread over the liquid L. Faster the rotation of the rotary cylinder 20, the greater the lowering of the liquid surface S resulting from the rotation of the rotary cylinder 20, and it is therefore preferable to regulate the rotational speed of the rotary cylinder 20 such that the liquid surface S is maintained in the vicinity of the emitting part 22 (e.g., at 3600 to 15000 rpm, or 15000 rpm or greater). It is preferable to suitably set the space (distance D in FIG. 2) created between the rotary cylinder 20 and the outer cylinder 30 so as to facilitate the desired lowering of the liquid surface S. For example, the space is 10 to 20 mm or 20 mm or greater.

Thus, according to the fine-bubble mixed liquid producing apparatus 1 of the present embodiment, a gas-liquid mixture discharged from the emitting part 22 due to the rotation of the rotary cylinder 20 is mixed with the liquid L while slicing the liquid, and it is thus possible to efficiently produce a fine-bubble mixed liquid containing fine bubbles such as microbubbles or nanobubbles.

Also, since the rotary blades 24 are radially disposed so as to extend from the inner circumferential surface of the rotary cylinder 20 toward the center, the rotary cylinder 20 can suppress an increase of rotational resistance in comparison to the case where the rotary blades are provided on the outer circumferential surface of the rotary cylinder 20, and can save electric power.

One embodiment of the present invention has been described in detail above, but the specific aspects of the present invention are not limited to the above embodiment. For example, the gas to be supplied to the gas-liquid mixing part 50 may be oxygen, ozone, carbon dioxide, nitrogen, hydrogen, or the like other than air, and these gases can be fed from the gas feeder 52 and retained as ultrafine bubbles in the liquid for a long period of time. For example, a fine-bubble mixed liquid that contains oxygen as fine bubbles in water can be suitably used for disinfection and sterilization.

As for the liquid L, a substance other than water can be suitably selected according to the application, and the liquid L preferably has a low temperature (e.g., 10° C. or lower) in order to maintain fine bubbles for a long period of time. In order to maintain the liquid L in the reservoir 4 at a low temperature, a refrigerating heat exchanger may be disposed around the reservoir 4 or immersed in the liquid L of the reservoir 4.

While the outer cylinder 30 is disposed so as to facilitate creating the desired bowl-like shape of the liquid surface S when the rotary cylinder 20 is rotated in the foregoing embodiment, the outer cylinder 30 is not an essential component, and, for example, in the case where the reservoir 4 is a small cylinder, no outer cylinder 30 may be provided.

While the introduction path 11*a* for introducing the gas-liquid mixture into the rotary cylinder 20 is formed in the output shaft 11 of the drive motor 10 to thereby enable the gas-liquid mixture to be stably emitted from the emitting part 22 in the foregoing embodiment, the introduction path 11*a* may be elsewhere other than in the output shaft 11, and the gas-liquid mixture may be introduced from the upper part or the lateral part of the rotary cylinder 20 via a mechanical seal or the like.

Figure 4:
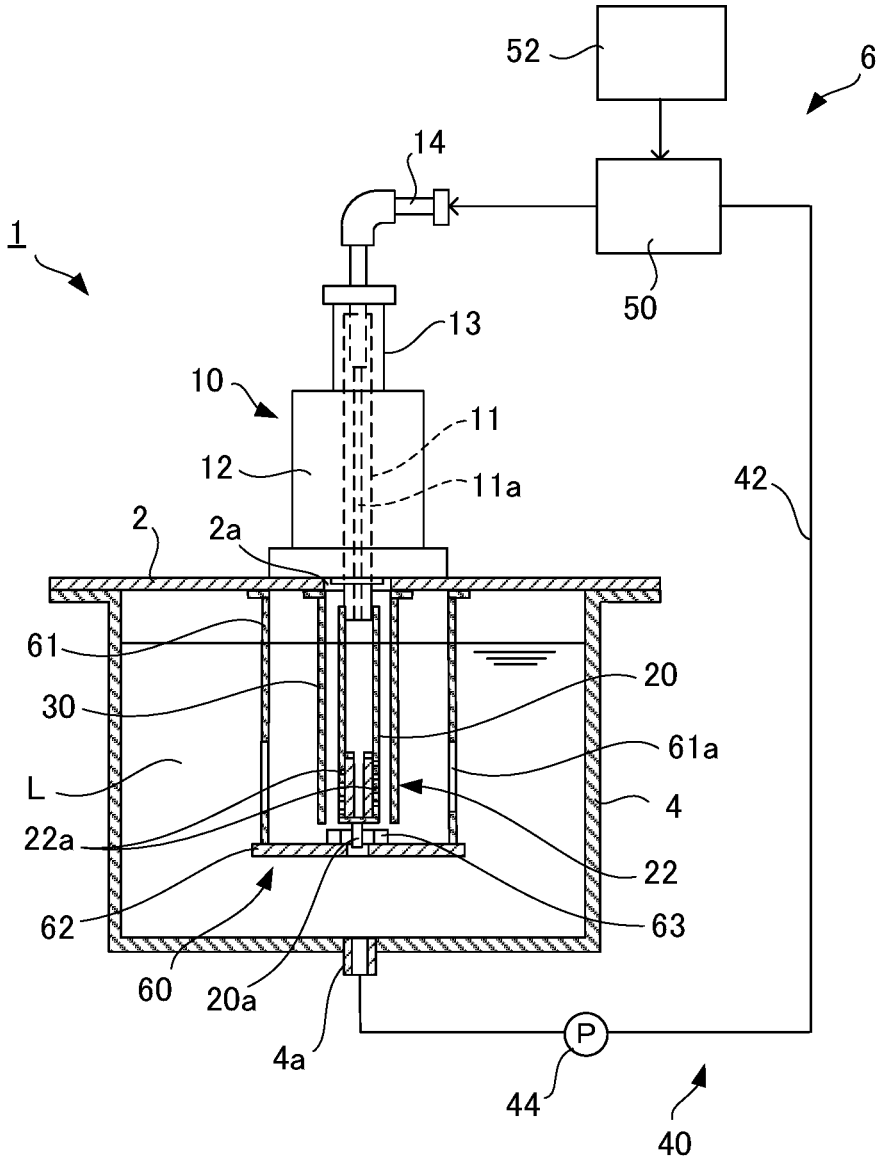
FIG. 4 is a vertical cross-sectional view of a fine-bubble mixed liquid producing apparatus according to another embodiment of the present invention.

As shown in FIG. 4, the fine-bubble mixed liquid producing apparatus 1 may further include a support member 60 for rotatably supporting the lower end of the rotary cylinder 20. The support member 60 includes a retainer plate 62 at the lower end of the support cylinder 61, the retainer plate 62 has a sliding bearing 63, and a distal end 20*a* of the rotary cylinder 20 is supported by the sliding bearing 63. A communication hole 61*a* for allowing the liquid L to flow between inside and outside is suitably formed in the support cylinder 61. According to this configuration, the rotary cylinder 20 can be more stably rotated, and a desired fine-bubble mixed liquid can be easily produced.

While the fine-bubble mixed liquid producing apparatus 1 shown in FIG. 1 is configured such that the fine-bubble mixed liquid can be continuously drawn out from the branch pipe 53, the fine-bubble mixed liquid producing apparatus 1 may have a batch-type configuration wherein the pipe 42 serving as a circulation path does not include the branch pipe 53 as shown in FIG. 4.

Figure 5:
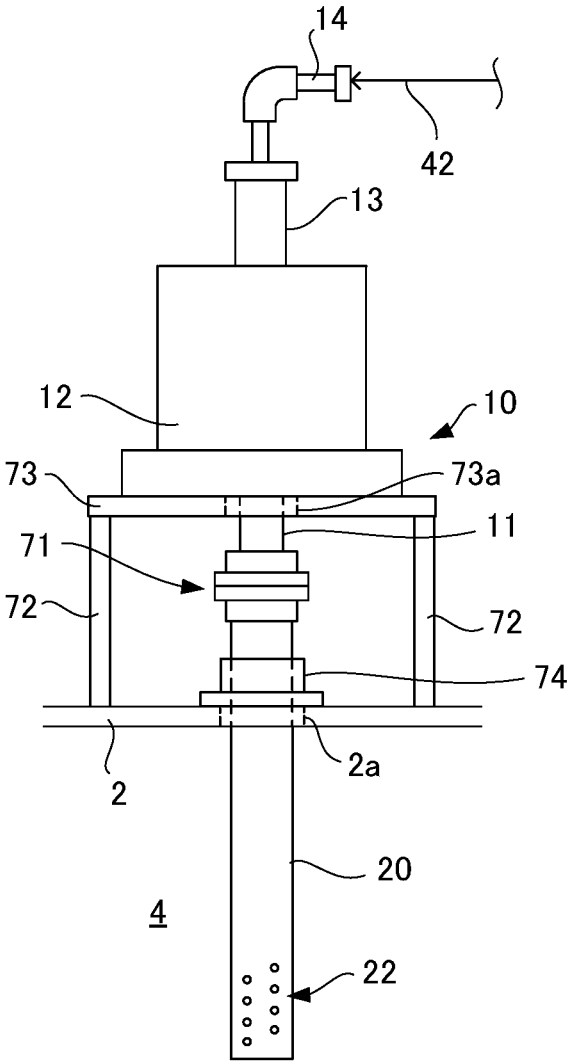
FIG. 5 is a side view of a relevant part of a fine-bubble mixed liquid producing apparatus according to yet another embodiment of the present invention.

While the rotary cylinder 20 is directly connected to the output shaft 11 of the drive motor 10 in the fine-bubble mixed liquid producing apparatus 1 shown in FIG. 1, the output shaft 11 and the rotary shaft 20 may be connected via a shaft coupling 71 as shown in the side view of a relevant part in FIG. 5. In this configuration, by providing a base plate 73 above the upper surface of the support plate 2 via a plurality of support columns 72 and forming a through-hole 73*a*, into which the output shaft 11 is inserted, in the base plate 73, the casing 12 of the drive motor 10 can be placed on the base plate 73. In order to maintain the airtight state inside the reservoir 4, it is preferable to provide a through-shaft seal 74, into which the rotary shaft 20 is inserted in an airtight manner, in the through-hole 2*a* of the support plate 2.

According to the configuration shown in FIG. 5, providing the shaft coupling 71 makes it easy to disconnect the inside of the reservoir 4 and the pipe 42, and thus maintainability can also be enhanced.

REFERENCE SIGNS LIST

1 Fine-bubble mixed liquid producing apparatus
4 Reservoir
6 Bubble feeder
10 Drive motor
20 Rotary cylinder
22 Emitting part
24*a* Rotary blade
30 Outer cylinder
40 Circulator
50 Gas-liquid mixing part
60 Support member
L Liquid

The invention claimed is:

1. A fine-bubble mixed liquid producing apparatus comprising a reservoir and a bubble feeding means for feeding bubbles to a liquid stored in the reservoir, wherein the bubble feeding means comprises:

a rotary cylinder having an emitting part on an outer circumferential surface, wherein the rotary cylinder is for being rotationally driven by a drive means, a circulating means for drawing out the liquid stored in the reservoir and feeding the liquid from the emitting part to the reservoir, and a gas-liquid mixing part for mixing bubbles with the liquid circulated by the circulating means, and by immersing the emitting part in the liquid stored in the reservoir and rotating the rotary cylinder, a bubble-mixed liquid is emitted from the emitting part, and a fine-bubble mixed liquid is thus produced.

2. The fine-bubble mixed liquid producing apparatus according to claim 1, wherein the rotary cylinder comprises rotary blades inside.

3. The fine-bubble mixed liquid producing apparatus according to claim 2, further comprising an outer cylinder disposed coaxially with the rotary cylinder such that there is a space between the outer cylinder and an outer circumferential surface of the rotary cylinder.

4. The fine-bubble mixed liquid producing apparatus according to claim 1, further comprising an outer cylinder disposed coaxially with the rotary cylinder such that there is a space between the outer cylinder and an outer circumferential surface of the rotary cylinder.

5. A method for producing a fine-bubble mixed liquid by mixing bubbles with a liquid stored in a reservoir, wherein a rotary cylinder having an emitting part on an outer circumferential surface is suspended; the rotary cylinder is rotated, with the emitting part being immersed in the liquid in the reservoir; the liquid in the reservoir is drawn out, mixed with bubbles, and then emitted from the emitting part; and the fine-bubble mixed liquid is thus produced.

* * * * *